United States Patent [19]

Brown, II

[11] Patent Number: 4,882,907

[45] Date of Patent: Nov. 28, 1989

[54] SOLAR POWER GENERATION

[76] Inventor: William G. Brown, II, 720 NW 31st St., Corvallis, Oreg. 97330

[21] Appl. No.: 186,919

[22] Filed: Apr. 27, 1988

Related U.S. Application Data

[60] Continuation-in-part of Ser. No. 765,824, Aug. 14, 1985, abandoned, which is a division of Ser. No. 486,087, Apr. 18, 1983, Pat. No. 4,549,604, which is a continuation-in-part of Ser. No. 122,357, Feb. 14, 1980, abandoned, which is a continuation-in-part of Ser. No. 816,501, Jul. 17, 1977, abandoned, which is a continuation-in-part of Ser. No. 788,207, Apr. 18, 1977, abandoned.

[51] Int. Cl.[4] ..... F01K 25/06

[52] U.S. Cl. ..... 60/649; 60/670; 60/673

[58] Field of Search ..... 60/649, 673, 642, 670; 62/484, 494; 165/1

[56] References Cited

U.S. PATENT DOCUMENTS

| | | | |
|---|---|---|---|
| 4,333,515 | 6/1982 | Wilkinson et al. | 165/1 |
| 4,338,268 | 7/1982 | Wilkinson et al. | 62/484 |
| 4,617,800 | 10/1986 | Assaf | 60/649 X |

*Primary Examiner*—Stephen F. Husar

[57] ABSTRACT

A solar cooling process is described in which tapwater is injected into an adiabatic flash chamber. A portion of the tapwater vaporizes to steam chilling the remainder. A special brine absorbs the water vapor in an absorber chamber. Then the brine is pumped over an open air evaporator where excess water picked up by the brine is driven off using solar or waste heat.

8 Claims, 3 Drawing Sheets

SOLAR POWER GENERATION

REFERENCE TO RELATED PATENT APPLICATIONS

The present patent application is a continuation-in part of U.S. patent application Ser. No. 765,824, now abandoned, which in turn is a division of U.S. patent Ser. No. 4,549,604 entitled SOLAR POWER GENERATION by William G. Brown, issued Oct. 29, 1985, which in turn is a continuation-in-part of U.S. patent application Ser. No. 122,357, filed Feb. 14, 1980, now abandoned, which in turn is a continuation-in-part of U.S. patent application Ser. No. 816,501, filed July 17, 1977, now abandoned, which in turn is a continuation-in-part of U.S. patent application Ser. No. 788,207, filed Apr. 18, 1977, also now abandoned.

BACKGROUND OF THE INVENTION

The present invention relates to absorption processes using a desiccant brine as a working fluid to capture solar or waste heat using the combination of an air evaporator and an adiabatic flash chamber.

Kasley, U.S. patent Ser. No. 2,005,377, 1935, describes an absorption power plant using an inexpensive open-air evaporator and using tapwater as boiler feedwater. His plant uses the evaporative capacity of air to drive water from brine in an open cycle and thereby benefits from improved cycle efficiency and reduced costs. However, his plant also boils water directly to steam promoting undesirable corrosion and mineral deposits which may offset the great advantage of the open evaporator. Natanson, U.S. patent Ser. No. 377,300, 1885, describes an indirect, flash-boiling process wherein he heats water in tubes and then flashes the water to steam in a chamber located away from the tubes and thereby allows any minerals to deposit in the noncritical chamber and not in the tubes. However, he does not use the evaporative capacity of air to drive water from liquid desiccant brine in an open cycle. The present invention uses a flash chamber in combination with an open evaporator. The advantage of the open evaporator is that it costs less than any other known evaporator. However, since the open evaporator loses water into the atmosphere, the process must use inexpensive water such as tapwater as makeup. Because of its immunity to minerals, the flash chamber allows the use of tapwater and makes the open evaporator feasible to use. Features of the present invention described herein make the inexpensive, open evaporator practicable.

The adiabatic flash chamber used in the present invention is to be distinguished from the chamber used by Albertson, U.S. patent Ser. No. 4,133,183, who shows water sprayed directly on coils within a vacuum chamber to generate steam. Spraying Albertson's coils with the inexpensive tapwater described herein would form mineral deposits. In loose terms, the flash chamber described herein has no heating coils. Instead, water flows through heating coils located elsewhere and does not vaporize until it enters the flash chamber where it then flashes to steam. In this configuration, minerals deposit in the flash chamber away from the heating coils which would otherwise be harmed by mineral deposits.

The present invention also features a steam absorber which uses a special flow configuration to achieve higher process efficiencies. Desiccant flows within the absorber, absorbs steam and releases heat to warm a stream of water which flows counterflow to the desiccant. The flow of desiccant is configured to prevent backmixing; this prevents the entering rich desiccant from being weakened and diluted by the weak desiccant which has already absorbed substantial amounts of steam. Soddy, Great Britain patent Serial No. 13337, 1952, also describes an absorber configured to prevent backmixing of the desiccant. However, Soddy does not show the counterflow arrangement for sensibly heating a stream of water. Instead, he boils water directly to steam, which for the use of tapwater as described herein, would result in the deposition of minerals from the tapwater onto the heat transfer surfaces. The present invention avoids mineral deposition and achieves higher process efficiencies.

SUMMARY OF THE INVENTION

One object of the invention is to use inexpensive feedwater containing minerals and yet not hinder operation by deposition of minerals and by corrosion on heat transfer surfaces. Another object is to use an inexpensive evaporator for capturing solar or waste heat. Still another objectis to exploit the evaporative capacity of air for enriching a desiccant to produce power or refrigeration. Yet another object is to use an inexpensive, benign desiccant brine. Still another object is to produce distilled water from brackish water or seawater while producing power or refrigeration. Yet another object for generating power is to operate the system at above ambient temperature using counterflow heat exchangers and yet not overcool the desiccant streams. Yet another object is to reconcentrate the desiccant at maximum efficiency. Still another object is to generate vapor away from the heat transfer surfaces to avoid deposition of minerals thereon. Yet another object is to reduce backmixing of weak brine into the rich brine admitted into the absorber and thus to increase operation efficiency. Still another object is operate the absorption process at lower temperatures to reduce corrosion and to permit the use of inexpensive plastic materials of construction. Yet another object is to provide for removal of dissolved solids which accumulate as the process vaporizes tapwater.

BRIEF DESCRIPTION OF THE DRAWINGS

Other objects of the present invention will become more apparent from the following detailed description of preferred embodiments thereof and from the attached drawings of which.

DETAILED DESCRIPTION OF PREFERRED EMBODIMENTS

Figure 1:
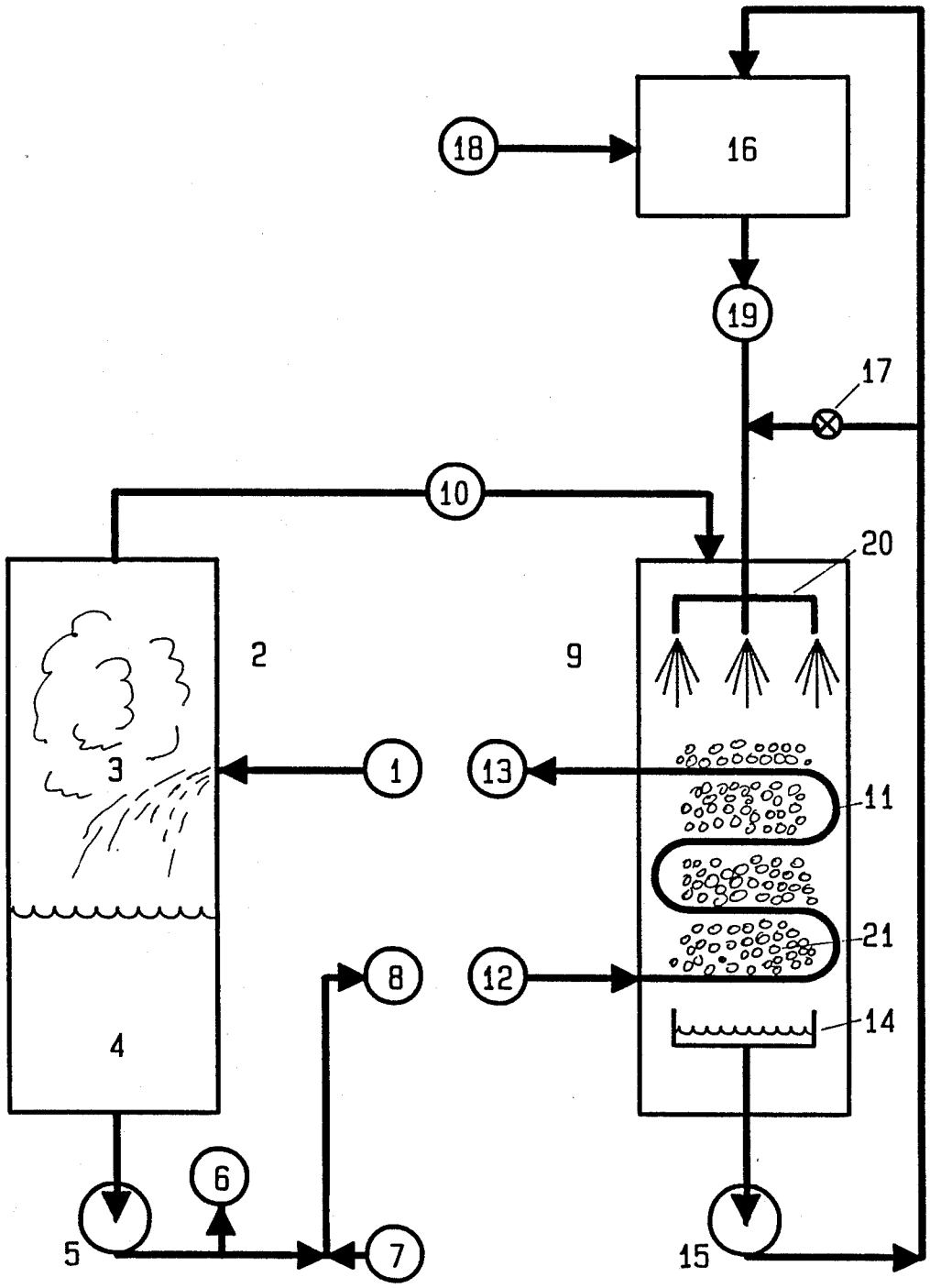
FIG. 1 is a schematic representation of an absorption process which may be used for heating and refrigeration or for power generation.

FIG. 1 is a schematic representation of an absorption process which may be used for heating and refrigeration or for power generation. Water 1 entering the flash chamber or "reduced heating zone" 2 flashes to steam 3 cooling the remainder 4 which is pumped 5 out of the flash chamber 2. To prevent build up of solids in the water, a small fraction may be blown down line 6, and along with the flashed portion, replaced with water from line 7 to form stream 8. Meanwhile, due to low pressure characteristics of the desiccant in the absorber chamber 9, steam 3 is drawn into absorber 9 through duct 10. For generating power, a turbine may be disposed along the duct 10. As the desiccant absorbs steam, it releases heat to the heat transfer surface of the coils 11 heating the stream of water 12 to a higher temperature stream 13. Most of the released heat converts into an increase in the sensible heat content of the water stream resulting in a rise in the water temperature instead of the heat converting to latent heat which would form steam in the stream 13. After absorbing the steam, the weakened desiccant falls into the catch pan 14, and is pumped 15 to an evaporator 16 and also recycled through the valve 17 to create more flow over the heat transfer surface of the coils 11. (Note that the valves are designated by a circled X in the diagrams.) Weakened desiccant in the evaporator 16 absorbs heat from solar energy or waste heat such as heat from a thermoelectric power plant. Excess water evaporates from the weakened desiccant forming rich desiccant 19 which then flows back into the absorber 9 through the distributor 20. The desiccant flows over the coils which may be interspersed with packing material 21 to provide increased surface area to aid in the absorption of steam. Specifically, for refrigeration, the stream is conditioned to the chilled water output stream 8 by flash evaporation. Meanwhile, the warmed stream 13 is recycled to a suitable cooling tower, for example, before returning as stream 12 to absorb more heat in the absorber 9. Note that the refrigerator application requires pressures of less than 0.5 psia in the flash chamber to chill water to temperatures of less than 79 degrees F.

In the power generation application, the steam passing through the duct 10 is expanded through a turbine to produce power and in the preferred embodiment, exhausts at 2 psia conditions. In addition, the heated stream 13 is returned to the flash chamber 2 as stream 1 to produce stream while the "cooled" stream 8 is returned to the absorber 9 as stream 12 to absorb more heat.

As defined here, the flash chamber is a "reduced heating zone" where more than half of the steam produced is derived from the heat in the stream of water entering the zone and is not derived from an additional source of heat such as a heating coil; the zone is substantially adiabatic.

Now describing the absorber in greater detail, the Figure shows four runs of horizontal tubing in the coils 11. The upper two runs may be considered to contact a first portion of the absorber and the lower two runs to contact a second portion of the absorber. Rich desiccant flows through the distributor 20 onto the coils 11 in the first portion of the absorber. As the rich desiccant absorbs steam, it releases heat and becomes intermediate-strength desiccant which then flows over the lower runs of tubing in the second portion of the absorber. There, it absorbs more steam, releases heat, becomes weaked desiccant and falls into the catch pan 14. Meanwhile, a stream of water 12 enters the coils 11 in the second portion of the absorber, warms upon absorbing the released heat and advances to the upper runs of tubing in the first portion of the absorber. There, it warms to a greater degree upon absorbing more released heat and then exits as the stream 13.

The second portion of the absorber is located downstream of the first portion to prevent significant backmixing of the desiccant from the second portion to the first portion of the absorber. Note that the term "downstream" is used in reference to the flow of desiccant. "Significant backmixing" is defined as a flow of desiccant from the second portion to the first portion which is greater than half the net flow of desiccant from the first to second portion. The advantage of reducing the backmixing lies in the fact that the rich desiccant can heat the stream of water to the highest temperatures when it is not weakened and diluted by weakened desiccant. Therefore it can heat the stream of water to higher temperatures to achieve higher efficiencies.

Clean heat transfer surfaces are also important to efficient heating; to prevent deposition of minerals in the coils 11, the stream of water not allowed to vaporize into sustantial amounts of steam within the coils. "Substantial amounts of steam" is defined as greater than ten percent by weight of steam in the stream of water 13. Note that the term "rich desiccant" (the same as "concentrated desiccant") and the term "weakened desiccant" are relative terms and that the weakened desiccant may actually be 50 percent by weight calcium chloride, for example. The term "intermediate-strength desiccant" is meant to refer to a desiccant which is less concentrated than a rich desiccant but more concentrated than a weak desiccant. A rich desiccant, as defined here, has a boiling point elevation of at least 12 degrees Celsius; at a brine temperature of greater than 112 degrees Celsius, it will absorb steam at standard atmospheric pressure. Water, as defined here, will boil at less than 105 degrees Celsius at standard atmospheric pressure. "High pressure steam" is also a relative term; in fact, it may refer to steam at a subatmospheric pressure. Note also that the term "stream" is not limited to a single channel of flowing water, but also includes a collection of smaller streams flowing in parallel as through a plurality of tubes. As well, the term "absorber chamber" would include a collection of smaller chambers through which a stream of desiccant flows. In addition, the term "turbine" is meant to include any engine suitable for expanding steam to generate power.

Figure 2:
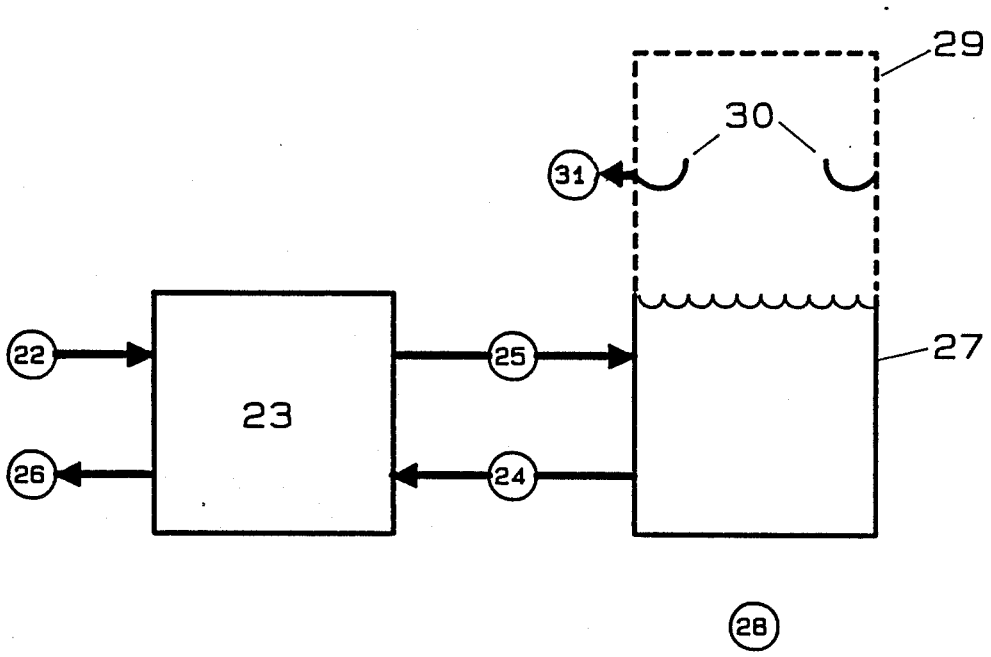
FIG. 2 is a schematic representation of an absorption power plant using seawater and producing distilled water.

FIG. 2 is a schematic representation of an absorption process using seawater and producing distilled water. Seawater 22 enters absorption plant 23 and is vaporized to salt-free steam which is absorbed into rich desiccant 24 in a process such as that shown in detail in FIG. 1. Sea salts left behind after vaporizing the water are blown down through the line 26. Meanwhile weakened desiccant 25 advances to evaporator 27 where solar energy or waste heat 28 drives excess water off leaving rich desiccant 24. The evaporated water condenses onto the surface 29 and drips down to the lips 30 and flows out as distilled water stream 31. Note that the term "seawater" is meant to refer to any water containing dissolved solids in excess of 0.1 percent by weight. Note that in relation to the FIG. 1, the streams 22, 24, 25, and 26 are analogous to the streams 7, 19, 15 and 6 respectively.

Figure 3:
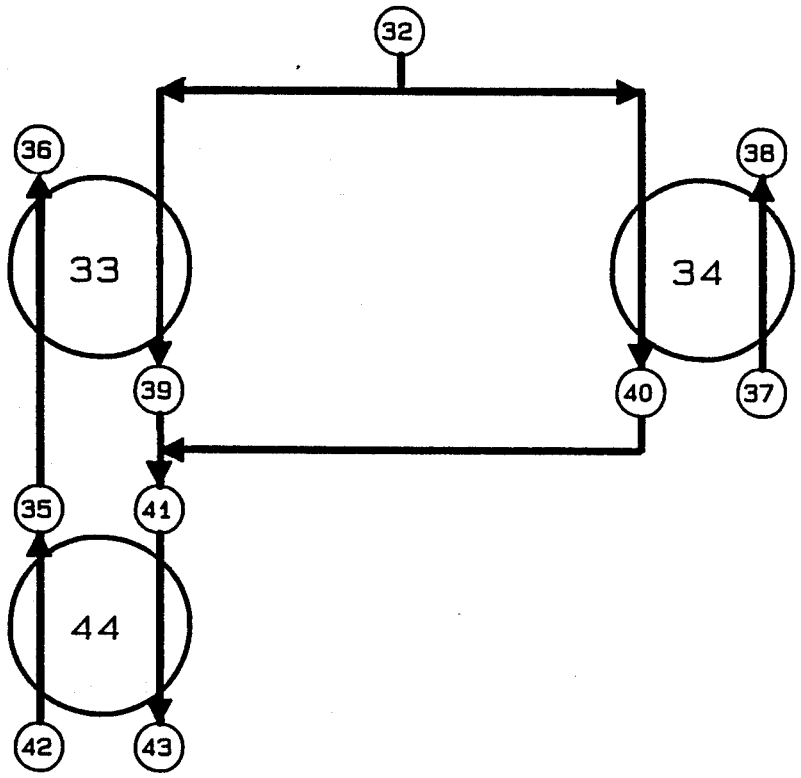
FIG. 3 is a schematic representation of a counterflow heat exchanger arrangement for preheating a desiccant and feedwater.

FIG. 3 is a schematic representation of a counterflow heat exchanger configuration suitable for preheating the feedwater and rich brine streams prior to introduction of these streams into the flash boiler and absorber respectively. As a heat source to accomplish this heating, hot weak brine is used which is discharged from the absorber. As the weak brine gives up its heat to warm the incoming streams, it becomes cool. Ideally, to warm these incoming streams as much as possible, as much heat as possible is extracted from the weak brine stream, thus cooling the weak brine as much as possible. It is important to extract the heat evenly to cool the weak brine without overcooling to avoid crystallizing the weak brine. Weak brine 32 from the absorber is split to feed the counterflow heat exchangers 33 and 34. A first portion of weak brine warms the feedwater stream 35 from intermediate temperature to warmest temperature 36 and a second portion to warm the cool rich brine stream 37 to warmest temperature 38. Weak brine streams 39 and 40 from the heat exchangers are then remerged to form stream 41 to warm the incoming cold feedwater to intermediate temperature. Due to the combined high flow rate of the stream 41, the weak brine is less susceptible to overcooling during contact with the cold feedwater 42. The stream 41 emerges without crystallizing as the stream 43 from the heat exchanger 44. As well, the apportioned flow rates of streams 39 and 40 achieve maximum heating of the feedwater and rich brine streams. In relation to the FIG. 1, the feedwater 36 and rich brine stream 38 exist the counterflow heat exchanger and flow as streams 7 and 19. In FIG. 1 the stream from pump 15 flows into the counterflow heat exchangers as stream 32.

Figure 4:
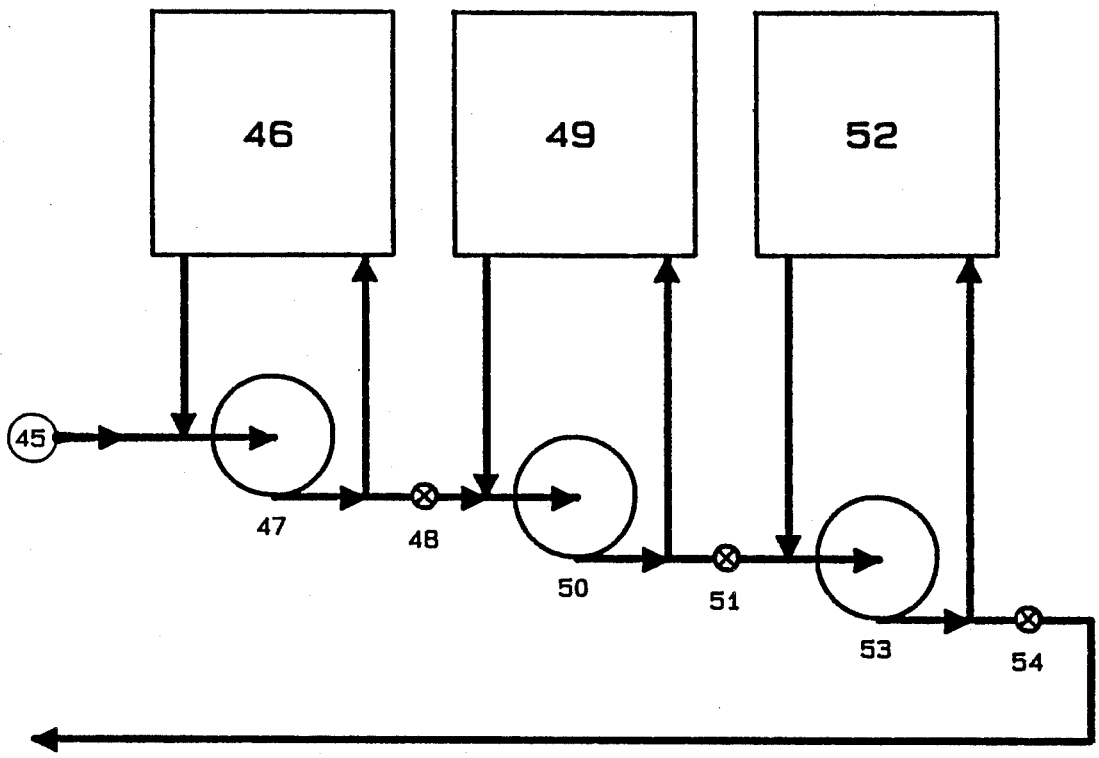
FIG. 4 is a schematic representation of a concentrating evaporator process.

FIG. 4 shows a schematic representation of an evaporator process suitable for concentrating brine for the power plant. Weakened desiccant 45 advances to the evaporator 46 where pump 47 maintains recycle over the evaporator 46. On account of water being driven from the desiccant, the desiccant is gradually enriched. The desiccant passes through the throttling valve 48 to evaporator 49 at slightly higher concentration and is similarly recycled and advanced by the pump 50 through the throttling valve 51 to the evaporator 52. After similar recycle pumping 53 over the evaporator 52, the desiccant is sufficiently enriched and is withdrawn continuously through the throttling valve 54. In the multiple evaporator process just described, the average concentration of the desiccant in the three evaporators is lower than the final concentration as would be withdrawn from a single recycling evaporator, thus increasing the evaporation efficiency which happens to be more favorable at a lower average concentration. The term "evaporation zone" is meant to refer to the active area of the evaporator such as evaporators 46, 49 and 52. In relation to the FIG. 1, the stream from pump 15 would flow into the stream 45, and the stream from valve 54 would flow into the stream 19.

Figure 5:
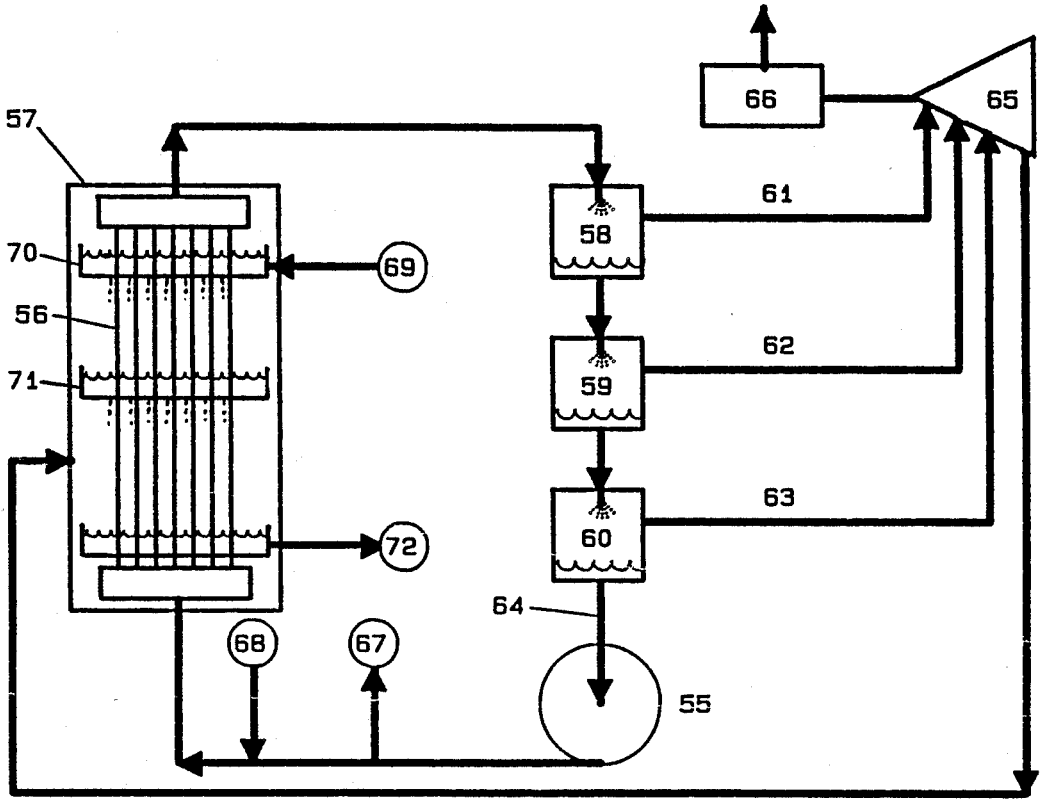
FIG. 5 is a schematic representation of part of an absorption power plant suitable for generating power more efficiently.

FIG. 5 is a schematic representation of part of an absorption power plant suitable for generating power more efficiently. This schematic shows the steam absorber, three flash chambers and turbine generator along with the flow lines. A single pump 55 pumps water through tubes 56 within the absorber chamber 57 and then consecutively through the flash chambers 58, 59 and 60. The water absorbs heat and warms as it flows through the absorber tubes and thermally contacts the warm desiccant in the absorber chamber. As the water stream advances further, it cools successively upon cascading through the flash chambers 58, 59 and 60 and fractions of the the water stream flash to relatively high pressure steam 61, intermediate pressure steam 62 and low pressure steam 63, leaving the remaining cooler water stream 64. The streams of steam flow to the turbine 65 to produce power and drive the generator 66. The turbine configuration is shown in greater detail in U.S. patent Ser. No. 4,611,522, Sept. 18, 1987, by William G. Brown. A portion of water is removed and blown down 67 to remove dissolved solids which accumulate in the water stream. Makeup water 68 is injected to replace the blowdown and flashed fractions. It should be noted that these dissolved solids enter the system as minerals in the makeup water, just as dissolved solids enter a typical water cooling tower. Therefore similar blowdown in required. Meanwhile, rich desiccant 69 flows into the absorber chamber and through the distributor tray 70 into a first portion of the absorber chamber 57. Upon absorbing steam, the rich desiccant releases heat and warms the water flowing inside the tubes within the chamber. Then the desiccant flows onto a second distribution tray 71 as intermediate strength desiccant. Here it flows into a second portion of the absorber chamber 56. Upon absorbing more steam, the desiccant releases more heat, warms the cooler water from pump 55 entering the chamber and the desiccant becomes weakened desiccant 72 which flows out of the absorber chamber. It should be noted that at least a major portion of the released heat is converted into an increase in the sensible heat of the water stream and raises the temperature of the water stream, not into an increase in the latent heat of the water stream and does not form steam in the water stream. This is critical in preventing the deposition of minerals within the tubes which would be greatly worsened by the formation of steam within the tubes.

Also note that dividing the absorber into first and second portions is arbitrary and that good distribution of the brine can prevent backmixing between the second and first portions without using the distribution trays shown. In reality, dozens of portions or ideal stages may exist within the absorber chamber thus promoting higher efficiency as will be explained. Upon absorbing steam, the richest desiccant entering the absorber chamber attains the highest temperatures, and warms the outgoing water stream to the highest water temperature. After weakening somewhat, the intermediate strength desiccant attains somewhat lower temperatures in the second portion of the absorber, but still is warm enough to warm the incoming cool water. Thus the absorber operates more efficiently, and warms the water to higher temperatures by preventing the weaker desiccant in the second portion from backmixing into the first portion and weakening the incoming rich brine.

Finally note that by using more than one flash chamber, a portion of the the steam is generated at higher pressures than is possible from a process using a single flash chamber. The present preferred embodiment employs a cascade of ten flash chambers to achieve a high process efficiency.

It will be obvious to those having skill in the art that many changes may be made in the details of the above preferred embodiments of the invention. Therefore the scope of the present invention should only be determined by the following claims.

I claim:

1. An absorption process comprising:

injecting a stream of water into a flash chamber to evaporate a fraction of said stream of water to produce steam and to chill the remainder;

removing and discharging as blowdown a portion of said remainder of said water stream to reduce the accumulation of dissolved solids in said water;

passing at least a major portion of said steam into an absorber chamber;

injecting a rich desiccant into a first portion of said absorber chamber to absorb steam, release heat and produce an intermediate-strength desiccant;

passing said intermediate-strength desiccant into a second portion of said absorber chamber located downstream of said first portion to prevent significant backmixing of weakened desiccant from said second portion into said first portion of said absorber chamber;

absorbing at least a portion of said injected steam into said intermediate-strength desiccant to release heat from said intermediate desiccant and to produce a weakened desiccant.

thermally contacting a stream of water with said desiccant in said second portion of said absorber chamber to transfer a major portion of said heat released from said second portion to said water to produce a warmer stream of water.

thermally contacting said warmer stream with said desiccant in said first portion of said absorber chamber to transfer a major portion of said released heat from said first portion to said warmer stream and to produce a still warmer stream of water.

removing at least a portion of said weaked desiccant from said absorber chamber.

2. The process according to claim 1 wherein at least half of all of said released heat is converted into an increase in the sensible heat content of said stream of water.

3. The process according to claim 2 wherein said steam is at a subatmospheric pressure.

4. The process according to claim 3 including the additional steps of:

flashing a portion of said still warmer stream of water to relatively high pressure steam;

passing said high pressure steam through a turbine to generate power.

5. The process according to claim 3 including the additional steps of:

flashing a portion of said still warmer stream of water to relatively high pressure steam and also producing a cooler stream of water;

flashing a portion of said cooler stream to relatively low pressure steam;

passing said high pressure steam and said low pressure steam through a turbine to generate power.

6. The process according to either claim 2 or 3 wherein said desiccant is a brine and wherein calcium chloride comprises at least 90 percent of the salt content of said brine.

7. The process according to claim 2 including the additional step of vaporizing water from a major portion of said weakened desiccant in an atmosphere of air to enrich said weakened desiccant.

8. The process according to claim 7 including the step of returning at least a portion of said enriched weakened desiccant to said absorber chamber.

* * * * *